United States Patent [19]

Jung

[11] Patent Number: 4,573,526

[45] Date of Patent: Mar. 4, 1986

[54] STEAM GENERATOR FLOW CONTROL DEVICE

[75] Inventor: Ingvar K. E. Jung, Nacka, Sweden

[73] Assignee: Westinghouse Electric Corp., Pittsburgh, Pa.

[21] Appl. No.: 475,587

[22] Filed: Mar. 15, 1983

[30] Foreign Application Priority Data

Apr. 28, 1982 [SE] Sweden ..... 8202676

[51] Int. Cl.[4] ..... F28F 9/22

[52] U.S. Cl. ..... 165/134.1; 165/159; 165/174

[58] Field of Search ..... 165/134 R, 174 R, 159; 137/592, 561 A

[56] References Cited

U.S. PATENT DOCUMENTS 1,987,116 1/1935 Leach ..... 165/134
3,351,131 11/1967 Berthold ..... 165/174

FOREIGN PATENT DOCUMENTS 647847 9/1962 Canada ..... 165/159
54-51051 4/1979 Japan ..... 165/134 R
27198 of 1897 United Kingdom ..... 165/174
203708 12/1967 U.S.S.R. ..... 165/159

*Primary Examiner*—William R. Cline
*Assistant Examiner*—Randolph A. Smith
*Attorney, Agent, or Firm*—F. J. Baehr, Jr.

[57] ABSTRACT

A flow control device for providing a substantially uniform and vortex-free inflow and distribution of feedwater to a steam generator having a tube bundle for a primary fluid disposed in a shell provided in the feedwater inlet nozzle including a diffuser structure, with a number of diffuser channels adapted to restrict outflow of water from the generator shell during a break in a feedwater pipe connected to the inlet nozzle and baffle means associated with said diffuser structure to deflect the feedwater flow in a radial direction about the inlet nozzle, the baffle means being arranged closely adjacent the inlet nozzle between the downstream ends of the diffuser channels and the tube bundle enclosed by the shell.

11 Claims, 17 Drawing Figures

STEAM GENERATOR FLOW CONTROL DEVICE

BACKGROUND AND SUMMARY OF THE INVENTION

The invention relates to heat exchangers of the tubular type, such as, for instance, feedwater preheaters, condensers and steam generators.

A problem involved with heat exchangers of this type arises due to the fact that the tubes adopt severe oscillations caused by turbulence and instability of the flow of liquid around the tubes. At times, the oscillations are so intense that the tube material is rapidly fatigued, a situation which often arises with condensers, for instance. It may even happen that the tube "beats" within a clearing between the tube and tube support plates provided with apertures through which the tubes extend, resulting in an abrasion of the tube material at contact surfaces between the tube and the support plate. The wear may proceed to such a degree that severe leaks arise. Evidently, such leakages are impermissible in nuclear reactor plants.

The principal object of the present invention is to provide a feasible means for solving this problem and particularly so in steam generator plants in which tube wear has already been observed or in new plants in which such wear may be expected.

With this object in view, the present invention resides in a device for providing a substantially uniform and vortex-free inflow and distribution of feedwater to a heat exchanger constituting a steam generator and comprising a plurality of tubes constituting a tube bundle for a primary fluid to heat said feedwater as the secondary fluid, and a generator shell enclosing the tube bundle and having an inlet nozzle, said inlet nozzle having therein a diffuser structure characterized by a number of diffuser channels adapted to restrict an outflow of water from the generator shell through said inlet nozzle during a break in a feedwater pipe connected to said inlet nozzle and arranged within the inlet nozzle and by baffle means associated with said diffuser structure to deflect the feedwater flow in a radial direction about said inlet nozzle and arranged closely adjacent the inlet nozzle between the downstream ends of the diffuser channels and the tube bundle enclosed by the shell.

The situation involved with heat exchanger tube oscillations is, generally, similar to the action of wind on non-stayed funnels. Inwardly directed vortexes, so-called Carman vortexes, arise in the windshadow behind the funnel, such vortexes giving rise to pulsating lateral forces. Such pulsating forces adopt a frequency $f_c$ which is dependent on the funnel diameter D and the wind velocity U. When, for a stayed funnel with low damping, the resonance frequency of the funnel is within the range $f_c=0.2$ to 0.7 times U/D, there is a risk that the oscillations will adopt such amplitudes that the funnel is damaged. The coefficient 0.2–0.7 is the dimensionless Strouhals number S.

$$S=f_c(D/U)$$

Extensive investigations on tube heat exchangers have shown that for high fluid velocities outside and crosswise through a tube bundle having one or more rows of tubes, severe vibrations arise for Strouhal's number within the range $S>2$, based on the velocity within the cross section between the tubes, or, for a normal tube pitch $S>0.7$, the entire free area in front of the tube bundle taken as a basis, substantially in analogy with the situation with unstayed funnels. If, in addition thereto, the flow is pulsating as to direction and intensity, the risk for tube oscillation is markedly increased. Usually, the oscillations show nodes at the support plates. Higher frequencies with nodes between the support plates may as well be present.

In general a flow distributor for a shell and tube heat exchanger having a shell side inlet nozzle so disposed in the shell that the central axis thereof is generally perpendicularly oriented with respect to the tubes, when made in accordance with this invention, comprises a flow distributor disposed within the shell on the shell end of the inlet nozzle. The flow distributor comprises a plurality of vanes which generally direct the flow of fluid from the inlet nozzle into the shell in a generally radial direction with respect to the axis of the inlet nozzle and a plurality of converging and diverging venturies disposed within the inlet nozzle upstream of the flow distributor vanes.

BRIEF DESCRIPTION OF THE DRAWINGS

The invention will become more readily apparent from the following description of a number of preferred embodiments thereof described in connection with the accompanying drawings, in which.

DESCRIPTION OF THE PREFERRED EMBODIMENT

Figure 1:
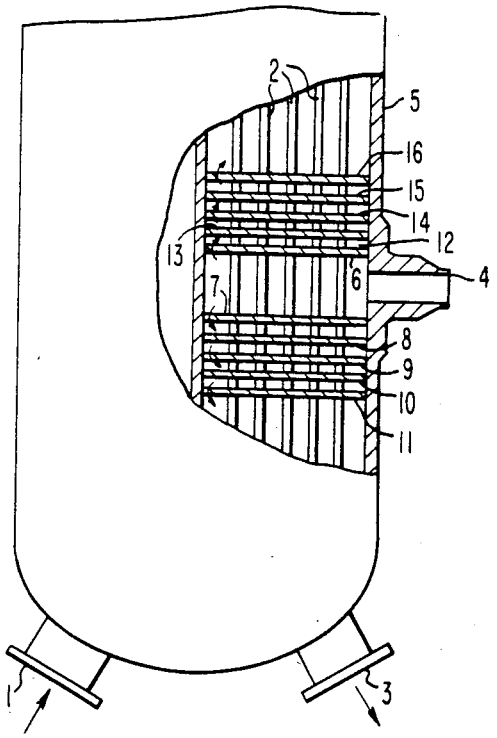
FIG. 1 PRIOR ART
FIG. 1 is a view of the lower part of a steam generator with the part thereof where the fluid to be heated, the secondary fluid, enters the steam generator, partially in section.

Referring now to FIG. 1, there is shown a prior art steam generator having a shell 5 to which hot pressurized water is supplied in a primary fluid circuit from a heat source, a nuclear reactor, for instance, through a primary water inlet nozzle 1 of the steam generator. Within the left half of the steam generator, the water flows upwardly through a plurality of closely packed tubes having a relatively small diameter, 20 mm, for instance. Within the upper portion of the shell the tubes bend downwardly within the right-hand half of the generator shell. Said last-mentioned tube portions within which the water flows downwardly, are represented by five tubes 2. After having supplied heat to the secondary water flowing around the tubes, the primary water returns through the outlet nozzle 3 to the nuclear reactor to be reheated.

The water of the secondary circuit, having about half the pressure of the primary circuit pressure, is supplied to the steam generator through a secondary water inlet nozzle 4 welded to the rigid shell 5 of the generator. Feedwater from a feedwater supply pump of the secondary circuit is considerably colder than the water vaporization temperature corresponding to the pressure prevailing in the major part of the secondary circuit of the generator. The cold feedwater is utilized for bringing about a drastic cooling of the primary water flowing through the lower right-hand tube section of the generator, said section thus functioning like an economizer. In the left-hand section of the generator and in the upper right-hand section as well, the hot primary water causes a vaporization of the secondary circuit water. Steam leaves the generator at the upper part thereof through a steam outlet nozzle, not shown, to a steam turbine after having passed a moisture separator.

From the inlet nozzle 4, the feedwater enters the space between the tubes of the tube bundle, across the tubes and between tube support plates 6 and 7. A portion of the flow bends downwardly and takes a zigzag course over the support plates 8–11 through orifices at their respective ends. A second portion of the flow flows upwardly along the support plates 12–16.

Figure 2:
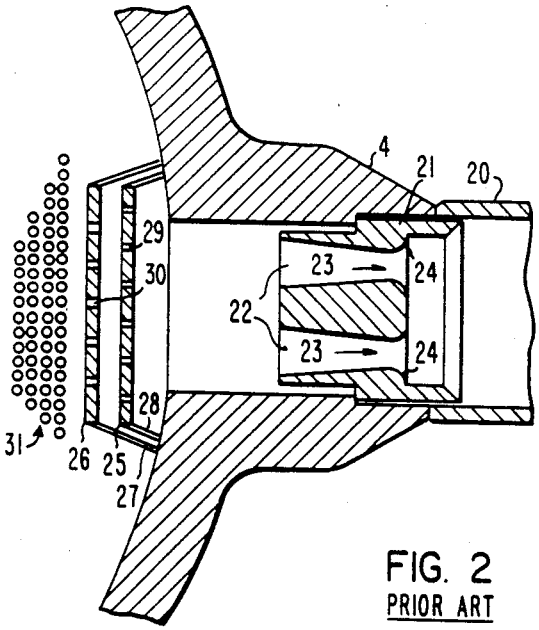
FIG. 2 PRIOR ART
FIG. 2 is a horizontal sectional view showing a secondary fluid inlet nozzle as existing in a prior art plant of a well-known type.
Figure 3:
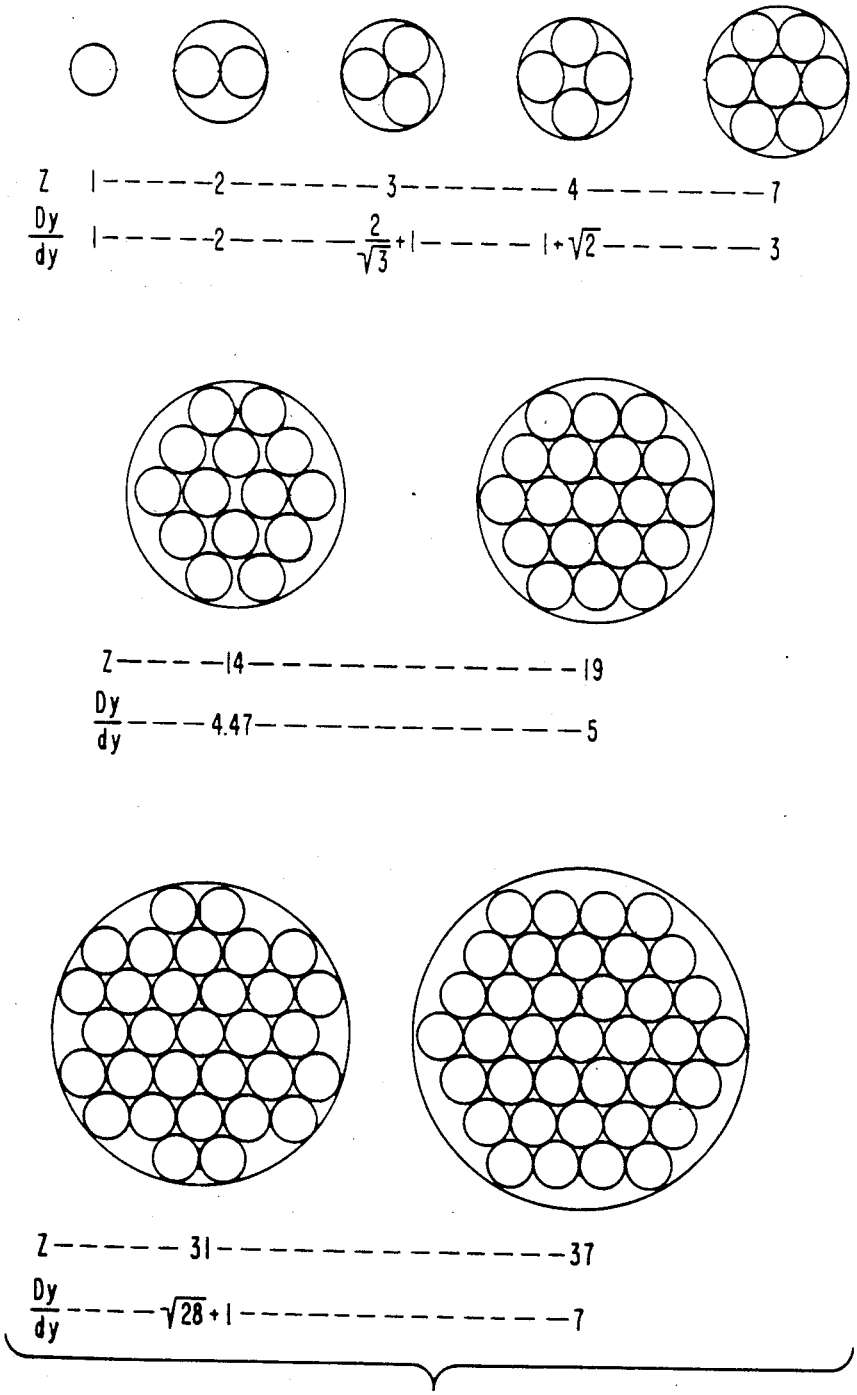
FIG. 3 shows a number of downstream sections of venturi nozzles having a circular section, arranged as a diverging nozzle unit with different numbers of identical diverging nozzles.

To explain the problems dealt with by the present invention, FIG. 2 shows more in detail a prior art steam generator inlet nozzle 4 with pertaining flow damping members in a horizontal section. A secondary water supply pipe 20 is connected to the inlet nozzle by welding. To secure that, for a possible pipe burst in the feedwater supply pipe, a restricted outflow only of secondary water from the steam generator shall arise, a flow restricting member 21, or venturi below called diverging nozzle unit, is arranged close to the feedwater pipe within the inlet nozzle 4.

The diverging nozzle unit 21 consists of a number, in the present case four, of diverging nozzle ducts 22 having a smallest orifice 23 after a smoothly rounded inlet surface 24. In the diverging portion of the nozzle a part of the momentum gained with the high velocity in the smallest orifice section 23, which may be as high as 30 m/s, is recovered. To prevent the water jets injected from the diverging nozzle channels with a still high velocity from hitting straight onto the tube bundle, two circular baffle plates 25 and 26 are arranged in front of the inlet orifice at some small distances therefrom. In a convenient manner, for instance by stays 27 and 28, said plates are secured to the shell 5 and provided with a number of apertures 29, to distribute the water flow. In spite of these measures the flow of water against the tubes 2 between the support plates 6 and 7 has, in some cases, been instable and powerful to such a degree that the tube rows adjacent the inlet have been exposed to vibrations, sometimes very heavy vibrations, leading to wear against the support plates causing severe leakages. When there is a question of primary water from a nuclear reactor, in which case the steam generator after some time of operation gets contaminated, it is extremely cost consuming and laborious to provide for extensive repairs of the generator shell or the internal parts thereof, and in particular in such parts which are not available through the inlet nozzle 4 after a removal of the unit 21.

With a device according to the present invention the water velocity after the nozzle unit 21 with its water velocity of about 30 m/s in the smallest section of the nozzles is decreased to such a degree that the feedwater flow, when entering into the tube bundle, has obtained such a low velocity that the tubes are not exposed to forced oscillations of an amplitude to endanger the mechanical strength of the tubes by wearing or fatigue.

To this end the inflow velocity of the feedwater should be brought down to about 2.5 m/s or below to obtain a sufficiently low Strouhals number.

According to the invention this is attained by the device having characteristic features as appearing from claim 1 of the accompanying patent claims.

In the following, the invention will be more closely described in connection with FIGS. 3 through 17.

To investigate the possibilities of obtaining a favorable liquid flow through the inlet cross section of a steam generator by the use of converging and diverging nozzles of circular cross section, the following calculation may be made. To start out from the premise that the velocity of the secondary water is to be decreased from the maximum velocity at the throat of the nozzle to a velocity as low and uniform as possible over the entire inlet section to the tube bundle of the steam generator, the number of converging and diverging nozzles, venturies or constrictions should be comparatively large and the outlets of the nozzles cover an area which constitutes as large a part of the inlet area as possible. The nozzle angle must not be larger than $2\times4°$ to obtain a stable and uniform flow through the diffuser portion of the nozzle, implying that the diameter increase after the smallest cross section of the nozzle should not be larger than $2\times7\%$ per length unit. For different numbers of nozzles a number of optimal figurations of the outlet cross section of the nozzle unit for circular cross sections according to FIG. 3, in which the ratio between the nozzle unit diameter $D_y$ and the outlet diameter $d_y$ of each diverging nozzle is indicated. The largest allowable area with respect to the throttling of the flow for a pipe burst being called $A_{min}$ and the number of nozzles z, the diameter of the nozzle at the throat will be $$d_i = \sqrt{\frac{A_{min} \cdot 4}{z}}$$

The cone angle set to $2\times7\%$, the length of the diffuser portion of the nozzle will be $$L = \frac{d_y - d_i}{0.14} = 7.14\,(d_y - d_i)$$

The coverage of the outlet section $\eta$ is then $$\eta = (z \cdot d_y^2)/D_y^2$$

As an example for a steam generator with a secondary water inlet nozzle having a diameter $D_y = 36$ cm, and a throttling area in the smallest cross section of the nozzles of 0.2025×cross section of the pipe, or 206.1 $cm^2$, the following minimum lengths L and coverage are obtained.

TABLE

| Number of nozzles z | $d_i/D_y$ 1 | Number of lines 1 | $d_y/D_y$ 1 | $D_y/d_y$ 1 | $\frac{d_y - d_i}{D_y}$ 1 | $\frac{L}{D_y}$ 1 | Coverage % | L cm |
|---|---|---|---|---|---|---|---|---|
| 1 | 0,45 | 1½ | 1 | 1 | 0,55 | 3,93 | 1 | 141,4 |
| 2 | 0,318 | 1 | 0,5 | 2 | 0,182 | 1,293 | 0,50 | 46,7 |
| 3 | 0,260 | 1 | 0,463 | 2,155 | 0,204 | 1,457 | 0,645 | 52,4 |
| 4 | 0,225 | 1 | 0,414 | 2,414 | 0,189 | 1,35 | 0,685 | 48,5 |
| 7 | 0,170 | 1½ | 0,533 | 3 | 0,163 | 1,16 | 0,777 | 41,19 |
| 14 | 0,120 | 2 | 0,244 | 4,47 | 0,1037 | 0,741 | 0,70 | 26,7 |
| 19 | 0,1032 | 2½ | 0,20 | 5 | 0,0968 | 0,691 | 0,76 | 24,9 |
| 31 | 0,0808 | 3 | 0,159 | 6,29 | 0,0782 | 0,558 | 0,783 | 20,1 |
| 37 | 0,0740 | 3½ | 0,1429 | 7 | 0,0689 | 0.492 | 0,755 | 17,7 |
| | 0 | | | | 0 | 0 | 0,91 | 0 |

From this table it is to be seen that the number of nozzles should preferably be at least 14 to bring down the required length of the nozzle unit to below the diameter of the unit. It is of interest to reach a length which is as short as possible and a coverage which is as high as possible, the number of nozzles being as low as possible. It will be seen from the table that the improvement of the coverage is comparatively small from 3 diverging nozzles up to 37 nozzles, and may for some purposes not be considered as satisfactory, only about ¾ of the inlet area being utilized, the diffuser length, however, decreasing from about 1.5 to 0.5 times the diameter of the nozzle unit.

In a preferred embodiment according to the invention, more closely described below, it is desirable to reach a coverage value approaching 100%.

As will be evident from the table, the number of diverging nozzle channels of circular cross section should, to obtain a length of the diverging portion of each channel of the unit which is shorter than the diameter of the supply pipe, have a number of at least 14, although 7 diverging nozzles obtain a more than 10% larger coverage, however at the expense of a considerably much longer length.

Thus, by arranging the diffuser channels of the diverging nozzle units so that the velocity from the smallest cross section of each diverging channel is decreased to the average velocity corresponding to not greater than 1.43 the velocity of the pipe cross section, a substantially uniform flow is obtained after the water has passed the nozzle unit.

A further improvement is obtained by arranging a number of diffuser rings constituting vanes for guiding the flow and applying to it a radial velocity with a selected velocity component in the direction of flow toward the tube bundle as more closely described below.

For steam generators, in which the secondary feedwater when supplied to the tube bundle is to be spread over a tube bundle, the width of which is much greater than the height thereof, a radial distribution is to be effected in the water flow from the nozzles, in such a way that more water is conducted in a horizontal direction than in a vertical one in order to obtain an acceptably uniform velocity distribution to each tube row, avoiding local high velocities. According to a further feature of the present invention, this is obtained by arranging separate diffuser nozzles having the shape of segments of a circle and dimensioned for selected water flows to be guided with a radial deflection in the direction of the outlet of the nozzle unit.

As an alternative for certain steam generator constructions, an embodiment according to the invention comprises one single, centrally arranged flow restricting nozzle in combination with a set of ring-shaped diffusers arranged downstream, the nozzle to deflect the flow into a substantially radial direction. As in the embodiment described above, the flows are distributed in such a manner that a larger part of the flow is being distributed in a horizontal direction than in a vertical direction.

Figure 4:
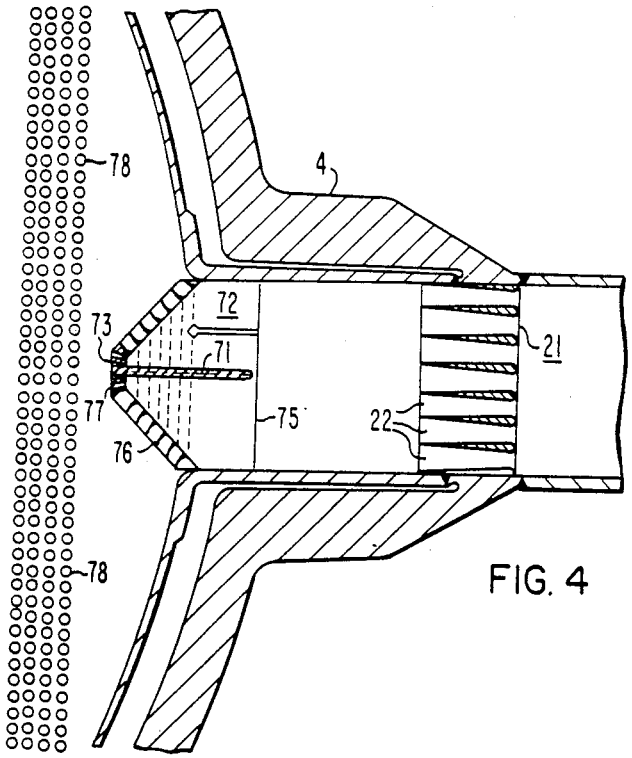
FIG. 4 is a partial sectional view showing a first embodiment according to the invention of the secondary fluid inlet and particularly suited for a steam generator, having a tube bundle with about the same height and width.
Figure 5:
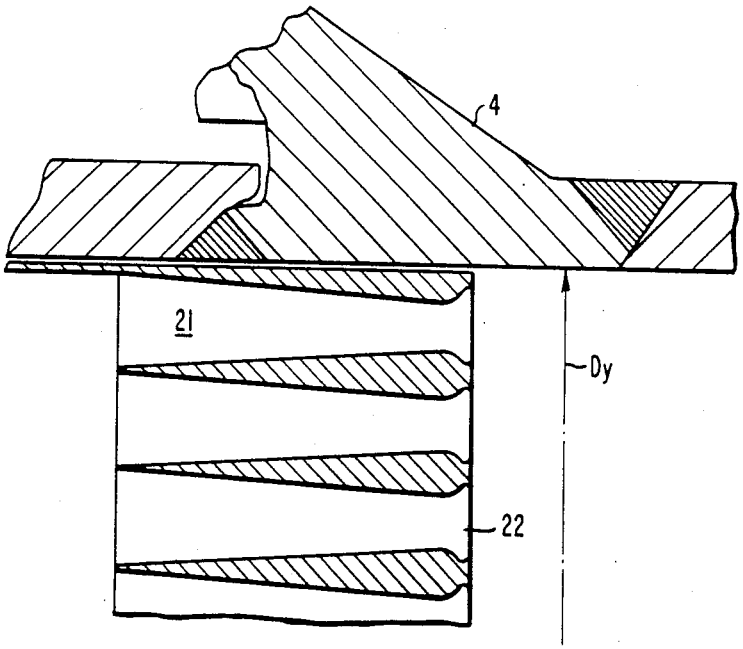
FIG. 5 is a partial sectional view showing a constructional example of the diverging nozzles of a diverging nozzle unit as in FIG. 4.

FIG. 4 shows a horizontal cross section of the steam generator inlet nozzle 4 having the diverging nozzle unit 21 which, in accordance with the invention, comprises diverging nozzle ducts 22. This embodiment is particularly suited for the secondary water inlet of a steam generator in which the height of the tube bundle is about as large as the width thereof. Combined with the diverging nozzle unit 21 is a cross-shaped plate member consisting of two plates 71, 72, which extend as two mutually crossing guide plates from the diverging nozzle unit in the direction toward the tube bundle.

The edges of the plates 71, 72 extending into the space within the generator vessel are cut at about 45° as shown, carrying at their top a member 73 having a number of substantially axial or somewhat diverging orifices 77. In order not to disadvantageously interfere with the outflow from the diverging nozzle unit 21, the edges 75 of the plates 71 and 72 facing the nozzle unit should be located at a distance from the nozzle unit.

Further, the cross-shaped plate member 71, 72 carries a number of diffuser vane rings 76 located at distances from each other covering the flow cross section. The diffuser rings 76 have a vane-shaped cross section and are directed to diverge the water flow, entering the generator substantially in a radial direction, thereby retarding the flow velocity before the water reaches tubes 78 of the tube bundle. The rings, shown in the Figure in a number of six, may consist of four portions, each secured at radial distances from each other between the plates 71 and 72. Preferably, the rings 76 are arranged with equal pitches, the vane shape being flared radially outwardly and selected with inflow and outflow angles to deflect the flow and obtain a uniform, substantially peripheral velocity having a selected component in the axial direction after the rings and to obtain favorable inflow velocities to the tube bundle.

As mentioned above, the coverage, that is the ratio between the sum of the downstream areas of the diverging nozzles of the nozzle unit 21 and the inlet duct area may, in some cases, not be considered to be satisfactory even for a high number of nozzles having circular downstream aperture, in that only $\frac{3}{4}$ of the secondary fluid pipe is being utilized.

Figure 6:
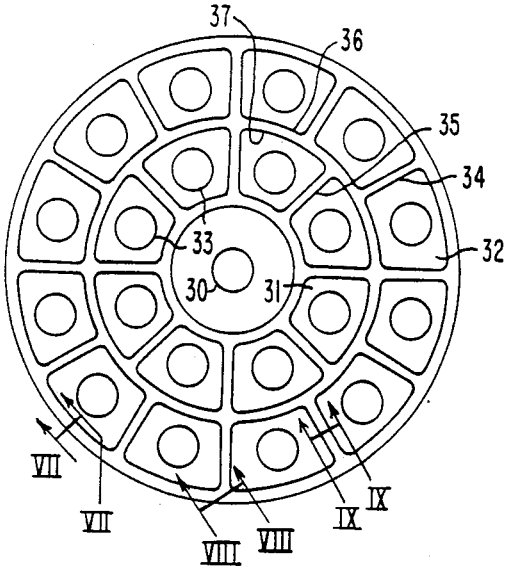
FIG. 6 is a downstream end view of a preferred embodiment of a diverging nozzle unit in a device according to the invention.
Figure 7:
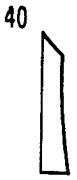
FIGS. 7, 8 and 9 are partial sectional views of the downstream walls of the diverging nozzle unit shown in FIG. 6 along the lines VII—VII, VIII—VIII and IX—IX, respectively, in FIG. 6.
Figure 8:
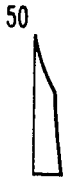
Figure 9:
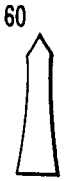

In a preferred embodiment of the invention and to obtain an improved coverage ratio, the diverging nozzle channels of the nozzle unit 21 having circular cross section over their full length are replaced by nozzle sections which, at the exit end of the unit, together form substantially annular sections. To avoid cavitations in the flow, the diffuser channels should be formed by walls sloped with respect to the flow direction by not more than 7°. The edge radius should be of the same order of size as the radius of the smallest section. Under these circumstances, the minimal length, as compared with circular nozzle cross sections, must be increased by a factor of 2 to obtain an optimal flow without cavitations at the edges. For a number of six diverging nozzle channels in the annular row of channels outside a central, circular nozzle channel, an unfavorable flow channel forms with a distance between the outer edges of about 1.6×the inlet diameter is obtained. By taking eight diverging nozzle channels instead of six around the central nozzle channel, a considerably more favorable arrangement is obtained. With an additional annular row around a row comprising eight channels, twelve channels will be optimal. A diverging nozzle unit 21 comprising twenty-one diverging nozzles is, consequently, considered as an optimal solution and is illustrated by FIG. 6, in which the nozzle apertures of the diverging nozzle unit is seen in the direction from the steam generator. The nozzle unit comprises a central circular diverging nozzle 30, around which two circular rows of eight diverging nozzles 31 and 12 diverging nozzles 32, respectively, are arranged, all with a circular smallest section 33 and with annular sector-shaped outlets. The outlets are more or less rectangular with radial side walls 34 and 35, respectively, and part-circular walls 36 and 37, respectively, extending along circles about the center of the central diverging nozzle. The edges of the annulus sectors are rounded, as mentioned above with about the same radius as the inlet radius. Preferably, the walls of adjacent diverging nozzles at the nozzle outlets are bevelled to terminate in a sharp edge, e.g. as illustrated by FIGS. 7, 8 and 9, showing edges 40, 50 and 60 of walls along lines VII—VII, VIII—VIII and IX—IX, respectively, of FIG. 6. Preferably, the diverging nozzle unit consists of a substantially cylindrical member of a material suited for the purpose.

For steam generators in which the space adjacent the feedwater inlet nozzle 4 in front of the tube bundle has a width which is by far larger than the distance between the tube support plates 6 and 7, FIG. 1, which serve also as baffle plates, the feedwater is to be distributed over the water inlet area of the tube bundle in such a manner that a considerably larger quantity of water is distributed horizontally than vertically. Means for providing such distribution of the feedwater are illustrated by FIGS. 10 to 15, showing an arrangement by which selected different water quantities are guided in different directions to fulfill this purpose. The diverging nozzles guide the flow within the separate annulus sectors into the space around the mouths of the nozzles, which are dimensioned to obtain an optimally directed inflow.

Figure 10:
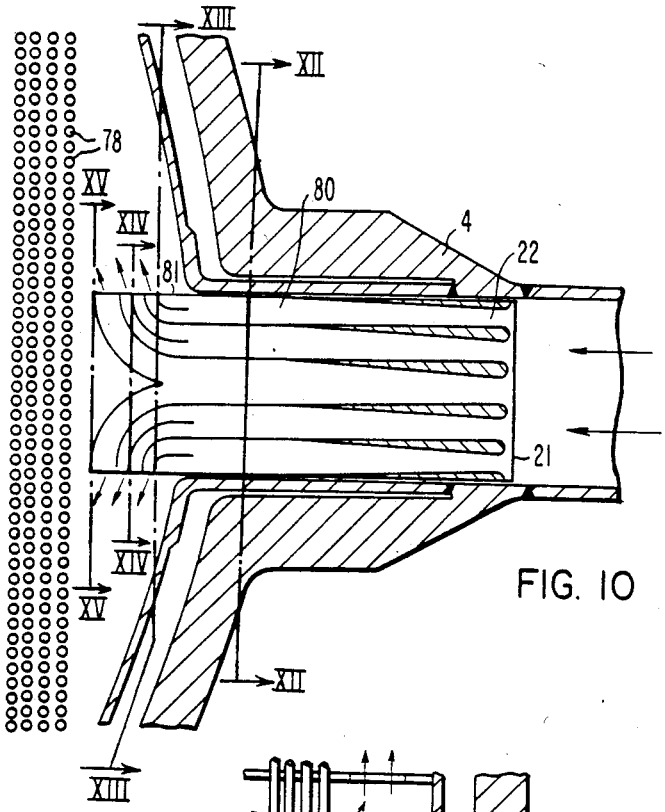
FIGS. 10 and 11 are horizontal and vertical, respectively, sectional views of a further embodiment according to the invention of a steam generator in which the tube bundle has a width which is substantially larger than the height between the tube support plates adjacent the inlet nozzle.
Figure 11:
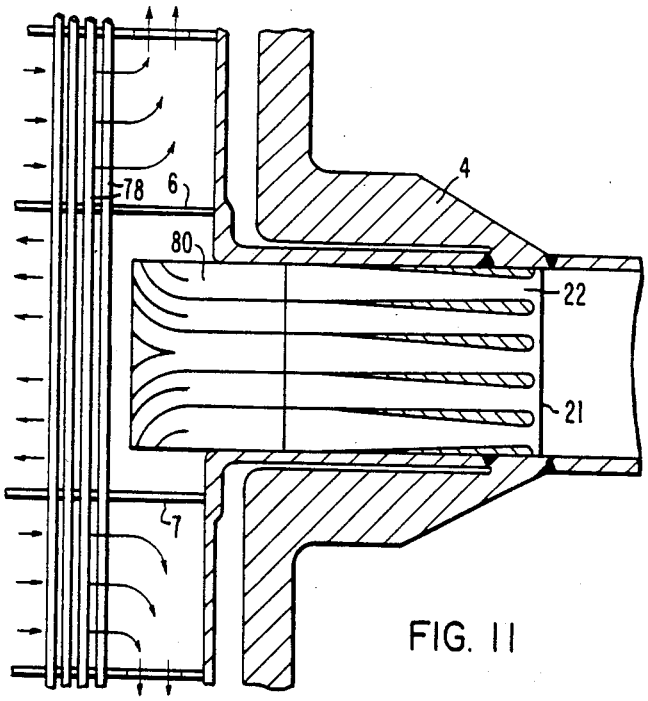
Figure 12:
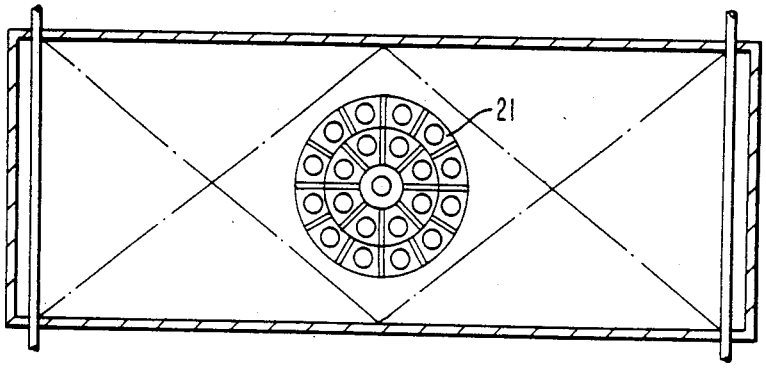
FIGS. 12–15 are vertical sectional views of means to distribute the outflow from the diverging nozzle unit respectively taken on lines XII—XII, XIII—XIII, XIV—XIV, and XV—XV of FIG. 10.
Figure 13:
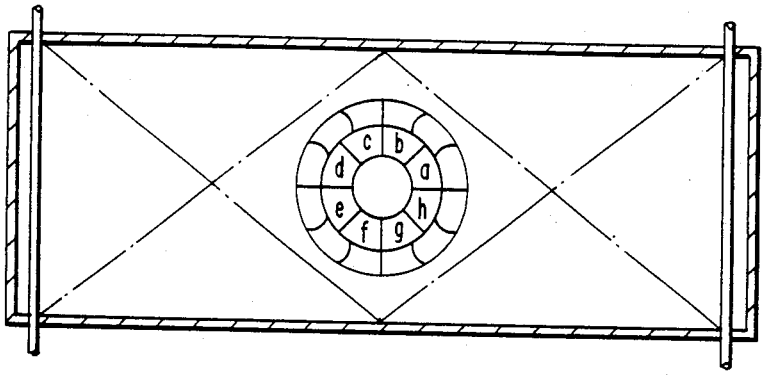
Figure 14:
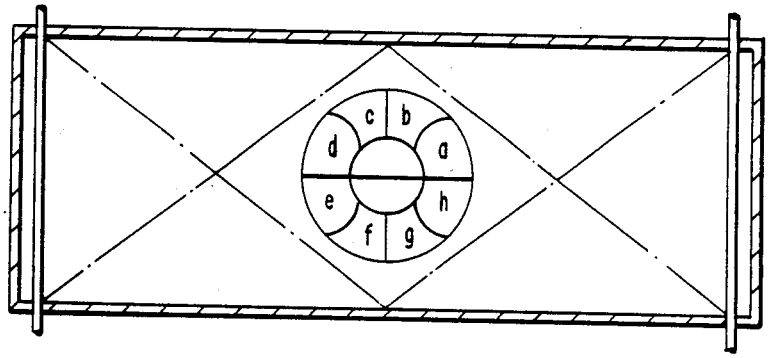
Figure 15:
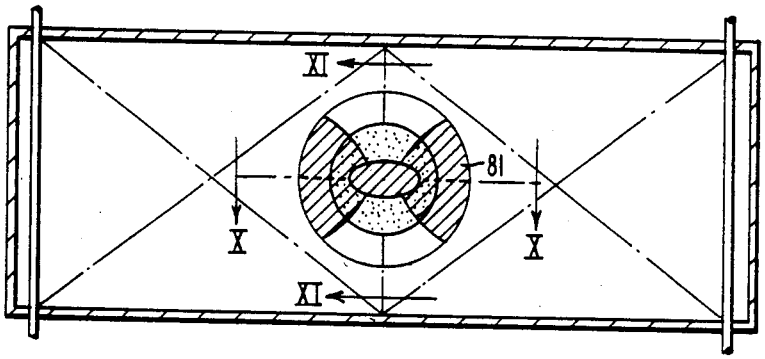

FIG. 10 is a horizontal section and FIG. 11 a vertical section through the diverging nozzle unit and the tube bundle. The cross section of the diverging nozzle unit 21 at a location where the diffuser portion of the unit is terminated is to be seen in FIG. 11. In a deflection portion 80 following the diverging nozzle unit 21, the annular sector shaped downstream ends of the diverging nozzles 22 are extended peripherally up to a baffle plate 81. As seen in the vertical cross section of FIG. 10, the flow quantities of the upper and lower nozzle outlets should be smaller than the quantities of the side nozzles, the flow of which is to be distributed far into the corners of the tube bundle enclosure. The supply of water in the vertical section should have a more axial direction than in the horizontal section, which is provided for by arranging the mouths of the nozzle outlets as illustrated by FIGS. 12 through 15, representing views in the axial direction of the inlet nozzle 4 of sections XII—XII, XIII—XIII, XIV—XIV, and XV—XV respectively. The flow deviating portion of the outlet channels from the respective diverging nozzles 22 is terminated by the baffle plate 81, directing the water flow radially and horizontally as regards the channels a, d, e and h of FIG. 13, while the flow from the central diverging nozzle and channels b, c, f and g are guided into a more axial direction, as will be seen from FIG. 11. The substantially radial walls of the annulus sector-shaped channels in the flow deviating portion of the channels are formed to distribute the flows emerging from the diverging nozzles in a direction toward the external portions of the tube bundle, as will be seen from FIGS. 13, 14 and 15, respectively. The deflection portion 80 is attached by welding to the diverging nozzle unit 21, so as to be attached to the inlet nozzle 4 as a unit by welding seams, arranged so as to keep the diverging nozzle unit 22 in place in case of a pipe burst.

Figure 16:
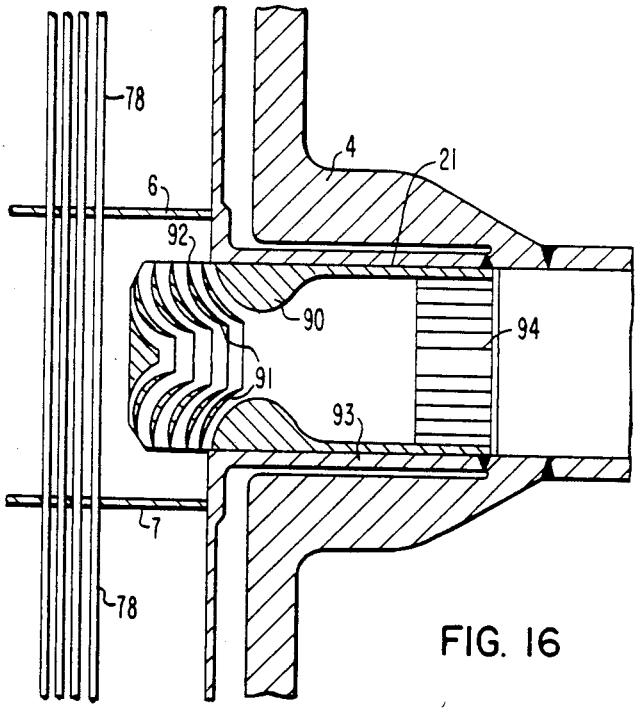
FIG. 16 is a vertical sectional view of still another embodiment of a device according to the invention.
Figure 17:
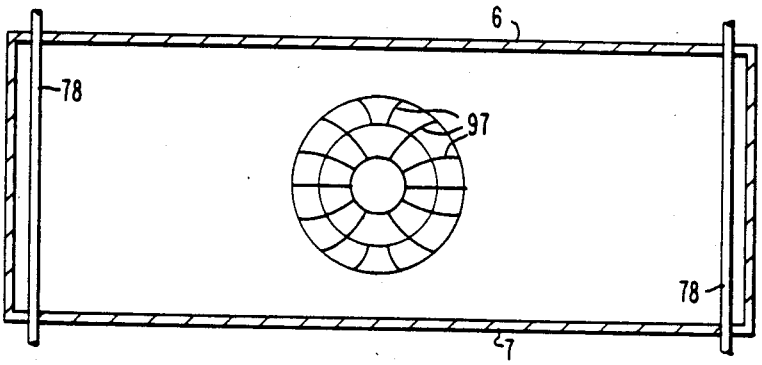
FIG. 17 is a vertical sectional view in the axial direction of the inlet nozzle of the embodiment according to FIG. 16.

FIG. 16 illustrates a further embodiment, in which pipe burst flow restriction is provided for by the use of one single nozzle 90 having, adjacent the smallest cross section area thereof, a plurality of annular diffuser vanes 91, within which the high velocity prevailing in the smallest cross section is reduced to acceptable values at the cylindrically shaped diffuser outlet openings 92 of the diffuser unit 21. The unit 21 is mounted within a tubular inlet stud 93. To assure a vortex-free inflow to the flow restricting nozzle 90, a flow rectifying plate member 94 having straight channels of square cross section is arranged ahead of the nozzle in the direction of flow. Downstream the smallest section of the nozzle 90, a number (such as five to seven) of diffuser rings 91 are arranged, as shown in FIG. 16, which are shaped so as to form diffuser channels. The axial and radial pitches of the diffuser rings 91 are flared radially outwardly and selected so as to obtain substantially uniform flow velocities where the water enters the tube bundle 78. As illustrated by FIG. 17, the annular diffuser channels 92 are subdivided by substantially radial guide walls 97, arranged so as to guide the flow outwardly to the external horizontal parts of the tube bundle and smaller flow quantities to spaces 96 above and below the inlet nozzle. Guide walls 97 support the diffuser rings 91 and hold together the diffuser unit 21. The diffuser ring may consist of machined rings 91, to which the guide walls 97 are attached by welding to the convex and concave, respectively, surfaces of the rings.

What is claimed is:

1. A flow distributor for a shell and tube heat exchanger having a shell side inlet nozzle so disposed in said shell that a central axis of said inlet nozzle is generally perpendicularly oriented with respect to said tubes;

said flow distributor being disposed within said shell on the shell side end of said inlet nozzle and having a plurality of vanes which generally direct the flow of fluid from said inlet nozzle into said shell in a generally radial direction with respect to said central axis of said inlet nozzle and said vanes being symmetrically disposed about perpendicular planes passing through said central axis, a first plane generally parallel to the tubes and a second plane generally perpendicular to the tubes, said vanes being formed to distribute a substantially greater portion of the inlet flow from said inlet nozzle in a general direction away from said first plane than from said second plane.

2. A flow distributor as set forth in claim 1, wherein the nozzle has a plurality of converging and diverging constrictions disposed within the inlet nozzle upstream of said flow distributor vanes.

3. A flow distributor as set forth in claim 2, wherein there are at least seven constrictions within the inlet nozzle.

4. A flow distributor as set forth in claim 2, wherein there are at least 14 converging and diverging constrictions within the inlet nozzle.

5. A flow distributor as set forth in claim 2, wherein there are at least 19 converging and diverging constrictions within the inlet nozzle.

6. A flow distributor as set forth in claim 2, wherein there are at least 20 converging and diverging constrictions within the inlet nozzle.

7. A flow distributor as set forth in claim 2, wherein the diffuser further comprises concentrically spaced annular walls; radial walls extending between the spaced annular walls; and said annular walls and radial walls extend from the end of the diverging portion of said constrictions to said vanes.

8. A flow distributor as set forth in claim 7, wherein the shell side ends of said annular walls flare radially outwardly and form some of said vanes.

9. A flow distributor as set forth in claim 2, wherein a portion of the vanes are elliptically shaped and flare out radially from the axis of the nozzle.

10. A flow distributor as set forth in claim 2, wherein the walls of the diverging portion of the constrictions form an angle with respect to a line parallel to the axis of the inlet nozzle which does not exceed seven degrees.

11. A flow distributor as set forth in claim 1, wherein the velocity of the fluid leaving the diffuser has a velocity not more than 1.43 times the average velocity in the full area of the inlet nozzle.

* * * * *